United States Patent [19]

Fleissner

[11] 4,176,531

[45] Dec. 4, 1979

[54] APPARATUS FOR THE WET TREATMENT OF TENSION-FREE GUIDED MATERIAL

[75] Inventor: Hans Fleissner, Basel, Switzerland

[73] Assignee: Vepa AG, Switzerland

[21] Appl. No.: 767,337

[22] Filed: Feb. 10, 1977

Related U.S. Application Data

[62] Division of Ser. No. 613,407, Sep. 15, 1975, Pat. No. 4,025,304.

[30] Foreign Application Priority Data

| | | | |
|---|---|---|---|
| Sep. 14, 1974 | [DE] | Fed. Rep. of Germany | 2444123 |
| Oct. 18, 1974 | [DE] | Fed. Rep. of Germany | 2449578 |
| Mar. 6, 1975 | [DE] | Fed. Rep. of Germany | 2509700 |

[51] Int. Cl.[2] ..... D06B 3/02

[52] U.S. Cl. ..... 68/3 SS; 68/15; 68/19.1; 68/20; 68/22 R; 68/43; 68/62; 68/158; 68/177; 68/184; 68/207

[58] Field of Search ..... 8/151, 151.2, 152, 156, 8/158; 68/22 R, 43, 44, 158, 181 R, 184, 177, 207, 3SS, 20, 62, 15; 162/211, 214, 317

[56] References Cited

U.S. PATENT DOCUMENTS

| | | | |
|---|---|---|---|
| 518,228 | 4/1894 | Dreze | 68/207 |
| 1,787,156 | 12/1930 | Lawson | 68/158 X |
| 2,391,096 | 12/1945 | Knight | 68/205 R X |
| 3,330,723 | 7/1967 | Nisser | 162/214 X |
| 3,410,119 | 11/1968 | Fleissner | 68/158 X |
| 3,631,982 | 1/1972 | Lejeune | 162/211 X |
| 3,708,262 | 1/1973 | Watanabe et al. | 68/44 X |
| 3,938,206 | 2/1976 | Stranger-Johannessen | 8/156 |

*Primary Examiner*—Philip R. Coe

*Attorney, Agent, or Firm*—Craig and Antonelli

[57] ABSTRACT

An apparatus for the wet treatment of fibrous materials includes a container filled with a treatment liquid, a liquid-permeable support for the material arranged with a supporting surface at least partially underneath a first liquid level within the container, and means for providing a second liquid level extending uniformly along the entire length of the immersed supporting surface and underneath said supporting surface of the support.

48 Claims, 14 Drawing Figures

APPARATUS FOR THE WET TREATMENT OF TENSION-FREE GUIDED MATERIAL

CROSS-REFERENCE TO RELATED APPLICATION

This application is a division of application Ser. No. 613,407, filed Sept. 15, 1975, now U.S. Pat. No. 4,025,304.

This invention relates to an apparatus for the wet treatment, such as, for example, for the washing, preferably also for the shrinking, of endless lengths of material in a wide, but especially in a band-shaped form, such as synthetic fiber strands [cables] deposited without tension, e.g. in folds. In this connection, it has been known to conduct this deposited material on a liquid-permeable support while transporting the material through a liquid bath.

Arrangements for the treatment of textile materials, such as for the relaxing, shrinking, washing, steaming, fixing, and drying of such materials have been known in great numbers; for the individual treatment steps, different devices have been employed, connected in series. It was found that it is necessary, especially for the washing, shrinking, and relaxing steps, to provide a dwell time within the container filled with the treatment fluid, in order to attain a shrinkage compensating for the thread tension during the production of the material, and simultaneously to provide that the material is rinsed on all sides, i.e. that the material is allowed to remain without tension below the level of the liquid during the residence time.

In order to fulfill this prerequisite, the provision of beaters has been proposed, which tend to maintain the upwardly floating textile material underneath the liquid level and simultaneously effect a conveyance of the textile material. In arrangements of this type which are used especially for the shrinking process, it has been found, however, that disadvantageous crease marks are obtained in case of articles sensitive to creasing.

DOS [German Unexamined Laid-Open Application] 1,460,357 discloses an apparatus for the wet treatment of loose fibers wherein the supporting surface for the endless belt is disposed closely underneath the liquid level, but at a spacing approximately corresponding to the thickness of the layer of material, in order to ensure a floating of the loose fibers in the treatment zone and simultaneously a continuous transport along the device with the aid of the endless belt. The fresh water is essentially introduced into this floating zone from sprinkler boxes arranged above the endless belt. Additionally, the treatment medium flows into the treatment chamber from backflow chambers in communication with the zone underneath the endless belt, laterally of the latter in the direction of the floating zone.

This conventional device is advantageous for the treatment of loose fibers, because the material supported by the endless belt can loosely float in the liquid and can be additionally transported during this step, without incurring the risk that floating fibers jam between the endless belt and the fixed lateral boundaries, namely on account of the laterally entering liquid. One disadvantage resides in that a substantial washing effect cannot be attained by this device; rather, the fibers are to float therein without being subjected to currents. A partial suction removal of the liquid with the aid of the pump of a sieve drum washing means disposed downstream of the endless belt does provide a weak current of liquid from the top toward the bottom through the endless belt, but this is insufficient to carry out a washing step.

A more intensive washing action can be attained by means of an apparatus as described in German Pat. No. 501,299, wherein a pump is arranged underneath a sieve-like endless belt which conveys the endless material; this pump conveys the treatment fluid through the endless belt and thus through the material and reintroduces the fluid above the endless belt into the treatment chamber. The thus-produced liquid flow, however, very substantially disturbs the treatment material lying on the belt, which is of no significance, for example, in connection with woven material deposited in folds, but must be avoided at any cost, for example, in case of endless strands [cable] of synthetic fibers consisting of a plurality of individual filaments and tending to tangle during the washing step.

The invention is based on the problem of developing an apparatus for the wet treatment, especially the intensive washing, of endless material, such as synthetic fiber cables [strands] deposited in folds, for example, wherein a uniform, intensive washing effect is made possible over the length and width of the deposited material, and wherein additionally a tangling of the individual filaments [fibrils] during the intensive washing procedure is avoided with certainty. Moreover, the apparatus of this invention is to be usable for the washing and/or shrinking, relaxing, steaming, fixing, and drying operations. Besides, a treatment process of any kind is to be ensured, operating without tension and being at the same time of a high quality. A further objective of the arrangement resides in offering the condition for obtaining a high water temperature which most desirably is to exceed the boiling point.

Starting with the process of the type described hereinabove, the invention provides, in order to solve the posed problem, that a layer of liquid is produced, and then maintained, above the conveyor support, this liquid, solely by the effect of gravity, flowing automatically through the material lying on the support, this flow taking place uniformly over the supporting area. Thus, the material is not only to float in the liquid above the conveyor support, but rather a liquid-free space is to exist underneath the support, so that a liquid flow is made possible over the entire length of the support which is uniform, directed from the top toward the bottom, and solely affected by gravity, making it possible to provide an intensive washing action without turbulence within the floating zone of the material.

It is furthermore advantageous to convey the textile material, placed from above on the conveyor support of the endless conveying means, thereon by means of a liquid layer built up above a liquid-permeable intermediate bottom of the vessel, this liquid layer being maintained and then uniformly flowing through the textile material due to gravity. By the provision of an additional intermediate [false] bottom underneath the endless conveyor, the buildup of a second liquid level underneath the conveying surface is likewise made possible, so that due to gravity a uniform liquid flow, oriented from the top toward the bottom, can be achieved admitting an intensive treatment of the material. Depending on the height of the desired liquid level above the endless conveying means, the variable throughflow resistance of the intermediate bottom is altered.

This liquid-free space within the container filled in total by treatment liquor is made possible by means of a liquid pump associated with the space below the preferably horizontally guided conveyor support. This pump conducts away the liquid, which has passed through the support, first more quickly and then optionally at a uniform rate, as new liquid is fed for replenishing purposes from the support. The liquid collected at the bottom can then be reintroduced from above. Thus, there is no intention of producing, by the thus-generated circulation of the liquid, a suction action on the liquid layer above the support; such suction would take in the treatment liquid from all sides in a radial pattern and thus would produce a nonuniform suction draft over the length of the support. Rather, the liquid is merely to flow due to earth's gravity in uniform amounts over the length of the support through the latter, so that the washing effect is uniform at any location.

As mentioned above, it is essential for the apparatus of this invention to obtain a quiet treating fluid above the support, yet effecting a downwardly oriented fluid flow. Furthermore, a liquid layer is to be produced which takes into account the permeability of the respective material and the desired washing effect. To make this possible in a simple fashion, the invention provides, in a further embodiment, that the liquid layer above the conveyor is varied in dependence on the strength of the desired throughflow. This can be obtained, in addition to influencing the quantity of the circulated liquid, also by affecting the perforation of the support. The layer of liquid above the endless belt thus is not only to correspond to the thickness of the layer of material, but is to be larger by far, in order to produce a desired liquid pressure.

To construct an apparatus for conducting the above described process, the invention provides means for generating a second level, uniformly over the entire length of the immersed conveying area, underneath the supporting surface of the endless belt. Thus, the material is not only to float in the liquid above the endless belt, but rather a liquid-free space is to be present underneath the belt, so that a liquid flow is made possible over the entire length of the endless belt which is uniform, directed from the top toward the bottom, and results in an intensive washing action without turbulence within the floating zone of the material.

This second level within the container filled in total by treatment liquor is made possible by means of a liquid pump associated with the space below the endless belt. This pump conducts away the liquid, which has passed through the endless belt, first more quickly and then optionally at a uniform rate, as new liquid is fed for replenishing purposes from the endless belt. Thus, there is no intention of producing a suction action by means of the liquid pump, which would take in the treatment liquid by suction from all sides in a radial pattern and thus would produce a nonuniform suction draft over the length of the belt. Rather, the liquid is merely to flow due to earth's gravity in uniform amounts over the length of the belt through this endless belt, so that the washing effect is uniform at any location of the belt.

In principle, a sieve belt, a lattice belt, or the like can be used for the endless belt. However, an especially advantageous and essential aspect of this invention is to fashion the endless belt as a perforated steel belt which eliminates a jamming of fibers between the wires of a sieve belt and which furthermore makes it possible to effect a tight seal with respect to the lateral boundaries of the treatment chamber by being sealed along these lateral boundaries by means of sliding seals. Thus, the sealing action along the longitudinal edges of the endless belt with respect to the adjoining walls is to be achieved solely by the sliding gasket. There is no laterally fed liquid for preventing an impending disappearance of fibrous material, since such a feature, namely the feeding of water—which takes place from the side in the conventional apparatus—would already entail turbulence in the zone of the liquid layer above the endless belt.

As mentioned above, it is essential for the desired function of the washing device to obtain a quiet treating fluid above the endless belt, and yet to effect a downwardly oriented liquid flow. To make this possible by a simple feature, the invention provides, in a further embodiment, to terminate the top edge of the container walls sealed with respect to the endless belt at a greater spacing above the endless belt. Thus, the liquid layer above the endless belt is to correspond not only to the thickness of the layer of material but rather is to be greater by far in order to generate an appropriate liquid pressure.

Particularly advantageous is a construction wherein the top edge of the lateral boundary of the endless belt terminates at a large distance above the endless belt; this feature is provided in a washing device of the conventional type where the lateral boundary of the belt at a spacing from the outer wall of the container is fashioned so that it forms with the space underneath the endless belt an overflow edge for liquid which is, for example, removed underneath the endless belt and is to be recycled into the treatment chamber. This measure does not serve, as is conventional, for essentially maintaining the level above the endless belt. In other words, this backflow channel is not to serve as a communicating vessel, but rather is to serve for providing a liquid circulation without contributing toward a turbulence in the layer of liquid above the belt. For this reason, it is thus necessary to arrange the top edges of the lateral boundaries of the endless belt at a larger distance above this belt.

To furthermore prevent any other kinds of turbulence in the liquid layer above the endless belt, the invention provides, in a further embodiment, one sieve plate [cover]—and optionally two sieve plates—in close superposition, extending transversely across the supporting surface of the endless belt, but underneath the liquid level. Thus, this sieve plate serves for smoothing the water which may be fed from the side and provides an absolutely quiet layer of liquid between the endless belt and the sieve plate.

In any washing machine, it is advantageous to pass the material to be treated through several washing compartments. Therefore, it is conventional to form several compartments in one washing machine. In the apparatus of this invention, this feature is made possible advantageously by forming within the vessel several treatment cells by means of partitions, these partitions being associated with squeeze rolls acting on the endless belt on both sides. In this construction, it would be advantageous to provide the pump for producing the level above the endless belt in the backflow duct formed by the lateral limitation of the endless belt and the adjacent outer wall of the vessel. If at all possible, each of these compartments should be associated with a pump, preferably controllable in its power, in the backflow duct, so that additionally a flow of liquid is produced within the entire device in opposition to the direction of the material to be washed.

An essential aspect of the function of the apparatus according to this invention is the fact that the endless belt in total is arranged underneath the level; however, on the other hand, the material is to be transported through the washing device, if possible, in folds which are formed more readily directly on the belt. In order to make it possible to deposit the material without problems and to make it simple to introduce the material into the treatment compartments, another embodiment of the invention resides in extending the endless belt past the first treatment compartment, formed by a partition, and arranging in this inlet compartment merely a liquid level underneath the endless belt. The same construction is also advantageous for the outlet compartment.

The apparatus of this invention is simple in its structure, makes it possible to effect a uniform throughflow and thus treatment of the material, and prevents an upward floating of the material to be treated. Furthermore, it is possible by means of this device to effect a washing step and/or a shrinking operation. Without altering the system, a steaming and fixation operation can also be conducted on the material to be treated, merely by building up a sump in the lower portion of the container, i.e. underneath the intermediate bottom, and heating the sump by a heating element. Depending on whether steaming or fixing is to be carried out, an appropriate liquor is fed to the lower portion of the container. Also a drying step can be executed under the exclusion of liquid by merely activating the heating element. These possibilities of using apparatus in accordance with the invention do not exclude, of course, the possibility of connecting, in case of greatly soiled material, a conventional sieve drum washing device either upstream and/or downstream of the apparatus of this invention.

The device according to the present invention offers the possibility, with a simple construction, of conducting all of the treatment stages for textile material in succession without additional means or alterations in the structure of the device.

Suitable endless conveyor means are endless belts. Furthermore suitable is a conveyor with chain-linked supporting bars extending at right angles across the operating width, on which the material is guided in hanging loops within the container, or a conveyor made up of two rows of rolls disposed below each other and offset in rows with respect to each other, making it possible to guide the material horizontally from the top toward the bottom within the container. The respective conveyor employed is dependent on the type of material to be treated.

The treatment fluid is introduced, in the device of this invention, onto the treatment material via nozzles or sprinkler boxes. For the uniform distribution of the liquid, a perforated cover can be installed above the respective endless conveyor.

To provide the mechanical impetus for the shrinking, relaxing, and washing operations, one or more smooth or perforated vibrating plates are provided above the guidance for the material; instead of the plates, it is also possible to utilize a vibrating belt. Also the use of a device generating ultrasound is possible for this purpose.

To be able to accommodate two or more different fluids in one device, for example for steaming and fixation purposes, the container portion present underneath the intermediate bottom can be subdivided once or several times at right angles to the working direction. Above the subdivision, squeeze rolls are provided to prevent a reduction in the intensity of effectiveness of the individual treatments.

To support the tension compensation within the fabric and the knit material, it is possible to subject the material to be treated, prior to entering the treatment chamber, to a stretching or overfeeding action by the arrangement of additional rolls.

In order to attain a superatmospheric pressure, the treatment chamber is fashioned along its length of a U-shaped cross section, wherein the liquid in the two legs is dimensioned so that it is at a higher or lower level, depending on the desired superatmospheric pressure.

The drawings illustrate several embodiments of the apparatus according to this invention. Still further patentable features of the apparatus will be described in detail with reference to these embodiments. In this connection, it is important that the individual features are of patentable significance not only by themselves but also especially in combination. In the drawings.

Figure 1:
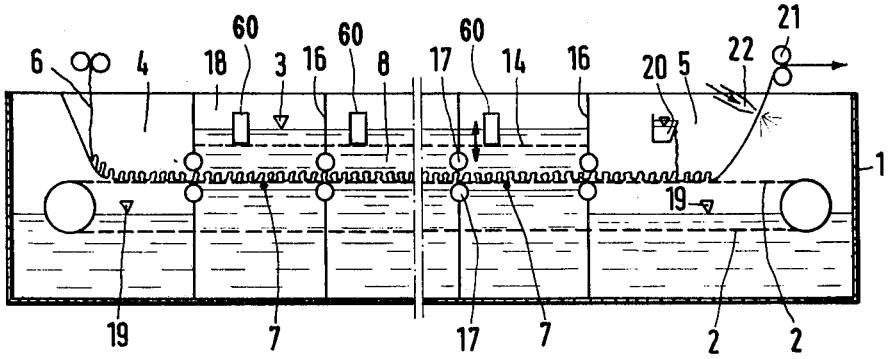
FIG. 1 shows a longitudinal section through a sieve belt washing device.

The device for washing, in particular, synthetic fiber cables—and which can also be provided for the tension-free treatment of fabrics and knits, to provide shrinkage of the material—consists according to FIGS. 1–4 of a container denoted by 1 through which extends longitudinally a liquidpermeable endless belt 2. Essentially, this endless belt 2 is arranged underneath the liquid level denoted by 3. According to FIG. 1, the supporting surface of the endless belt 2 is free of liquid merely at the inlet 4 and at the outlet 5, while according to FIG. 3 the endless belt 2 extends out of the container.

The essential feature for the washing device is the unimpeded flow, directed uniformly from the top toward the bottom over the length and width of the treatment section, through the endless belt 2 and thus through the material 6 which, to make a dwell treatment possible, is deposited on the belt in folds. A prerequisite for a tangle-free penetration by the liquid medium is additionally a liquid current free of any turbulence, which latter can be produced already easily by spraying new washing fluid thereon. The conditions are met by producing a second level 7 provided underneath the supporting surface of the endless belt 2, a free air space being present above this second level. On the basis thereof, the liquid layer present uniformly over the width and length of the entire endless belt above the latter in the treatment chamber 8 can flow vertically through the material in the downward direction. The throughflow velocity is not to depend on the power of a pump which optionally sucks the liquid through the material, but rather on the height of the liquid layer on top of the endless belt 2.

In order to produce the level 7, i.e. an air space underneath the endless belt 2, a pump 12 is associated with the space underneath the endless belt; this pump carries away the liquid which has flowed through the belt to the same extent as it flows through the belt 2 and through the material 6. In this connection, care is to be taken that the free space above the level 7 does not become too high, in order to avoid foam formation.

In the embodiment of FIG. 1, the treatment chamber 8 is separated by a wall 9 laterally of the endless belt 2. The lateral limitation 9 of the treatment chamber 8 is arranged at a spacing from the outer wall of the vessel 1, so that a backflow duct 10 is formed. This duct 10 extends over the entire length of at least the treatment compartments. By the pump 12, driven at variable speeds by the motor 11, the liquid which has passed through the belt is removed from the space below the endless belt in accordance with the arrows indicated in the drawing and recirculated by the pump over the top edge 13 of the lateral limitation 9 into the treatment chamber 8.

Figure 3:
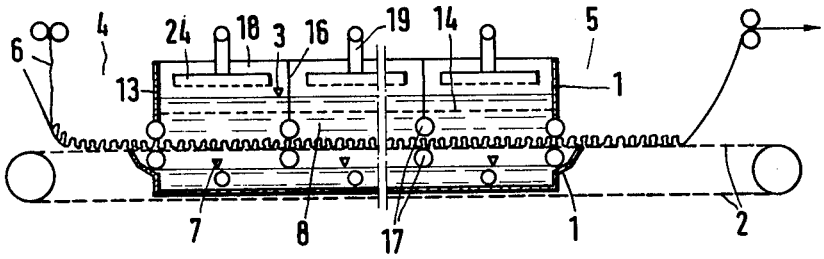
FIG. 3 shows a sieve belt washing device similar to that of FIG. 1.
Figure 4:
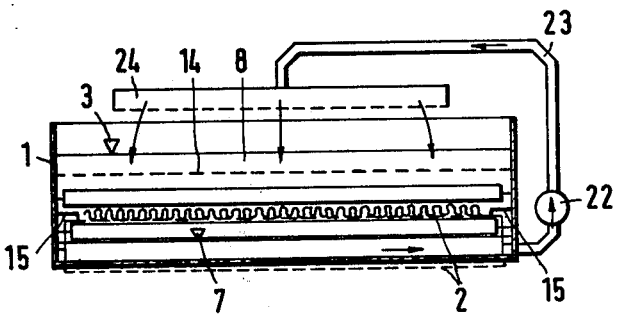
FIG. 4 shows a section transversely through the arrangement of FIG. 3.

In the embodiment according to FIG. 3, a pump 22 is arranged laterally of the endless belt 2, connected with the space underneath the endless belt 2 and underneath the level 7. Thus, the liquid collected at the bottom is taken in by the pump 22 and fed via the conduits 23 to the sprinkler box 24 disposed above the treatment chamber 8. The pump should be controllable in its efficiency, so that the liquid layer above the belt 2 can be adapted to the respective conditions.

The top edges 13 of the lateral boundary 9 according to FIG. 1 and those of the walls of the container 1 according to FIG. 3 are arranged at a larger distance from the supporting surface of the endless belt 2, in order to produce a larger liquid layer and additionally to offer the possibility of a smoothing of the liquid. For this purpose, a perforated plate 14, which can also consist of two superimposed, permeable plates, is arranged underneath the top edge 13, but above the supporting surface of the endless belt. The liquid entering from duct 10 according to FIG. 1 laterally into the treatment chamber 8 is, on the one hand, uniformly distributed through this perforated plate 14 over the operating width and, on the other hand, any turbulence which unavoidably occurs during this step is compensated for thereby, so that solely a downwardly directed liquid flow exists underneath the perforated plate 14. The same is obtained in the embodiment of FIGS. 3 and 4, except that in the latter case the liquid is fed from the sprinkler boxes 24. A vibrating means 60 for providing vibration in the treatment liquid is arranged above the conveyor belt and may generate ultrasonic vibrations. The means are in contact with plate 14 to cause vibration thereof.

The material to be treated with this washing machine, i.e. especially the synthetic fiber cables, consist of a plurality of individual fibrils which are incoherent and readily tangle when wetted with water and which can alter their original position when floating in the liquid, especially during the directional floating of the material. During this step, individual fibers enter the openings of the liquid-permeable endless belt 2 where they can interlock and jam up. In order to avoid this phenomenon, the endless belt 2 in the device of FIGS. 1–4 is made from a perforated steel belt where a jamming of the fibers is impossible. The longitudinal edges of the belt are sealed off with respect to the fixed walls of the housing by sliding seals 15 firmly in contact over the entire length. These sliding seals effect a flawless sealing action especially in case of a smooth steel band, so that also at that location a jamming of the fibers or a deleterious liquid current through the seal, which would cause jamming, is prevented.

Figure 2:
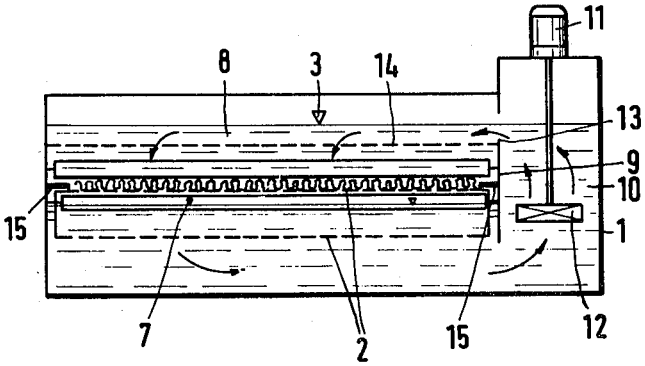
FIG. 2 shows a section transversely through the arrangement according to FIG. 1.

The treatment section of the washing device according to FIGS. 1 and 2 is subdivided into several compartments. These compartments are formed by partitions 16 followed on both sides of the supporting surface of the endless belt 2 by pressure rolls 17. These pressure rolls not only seal the respective compartments with regard to the passing endless belt with the material, but also exert a certain squeezing pressure on the material to attain partial dewatering. The squeezing pressure must not be too high, depending on the material, so that a permanent deformation of the vertically disposed cables is avoided. Optionally, the rolls are even adjusted with respect to their nip. Each of these washing compartments 18, formed by the partitions 16, is associated with a liquid pump 12 in the backflow duct 10, according to FIG. 1, and with a pump with the conduits 23, according to FIG. 2. By connecting lines, not shown, between adjacent compartments or by collecting tanks, arranged in cascade, a countercurrent flow of the treatment liquid in opposition to the conveying direction of the material 6 is ensured.

There is no pump 12 associated with the inlet compartment 4 of FIG. 1 and also with the outlet compartment 5; rather, merely a level 19 underneath the supporting surface of the endless belt is provided in these compartments, which level is produced by the leakage fluid at the first and last pairs of pressure rolls. This leakage fluid then needs only to be conducted into the first or last washing compartment. In contrast thereto, in the example according to FIG. 3 the wall of the collecting compartment is extended only up to the lower pressure roll to the belt 2 to define a boundary for the apparatus and to collect the leakage fluid. Thus, in the inlet compartment 4, the material can be deposited on the endless belt without impediment; from there, the material can be continuously introduced through the first pair of squeeze rolls into the first washing compartment 18. At the outlet, the material exiting with the aid of the belt 2 through the last pair of squeeze rolls 17 can drain off on the belt and—if desired—can be additionally subjected to a final cleaning step with fresh water and can especially be cooled. The synthetic fiber cables can travel directly from the crimping apparatus into this washing machine, where a wet setting can be effected in case of polyamide cable. In this case, a final cooling step before application of the folded position is advantageous. To introduce the water, a unit 20 is arranged above the exiting endless belt 2 according to FIG. 1; a water curtain flows uniformly onto the material from this unit over the operating width. Subsequently, the material is removed from the belt by means of a take-off device 21 and optionally previously freed from the largest part of the liquid still contained in the material by means of a blower 22 or a suction means.

FIGS. 5-12 show several other embodiments of washing devices and other devices wherein the invention is realized. The apparatus of FIG. 5 comprises the vessel 1 and the cover 25 extending with its sidewalls 26 over the sidewalls 13. The textile material 6, present in panel lengths is introduced from the top into the vessel via the rolls 27, 28, and 29. The endless conveyor 30, disposed entirely within the vessel, consists of a chain to which are mounted carrying bars 31 extending transversely across the width and being arranged at mutual spacings. The textile length 6 is suspended in loops 32 between the carrying bars 31 and is guided in this loop form through the liquid bath of the vessel 1 by means of the moving conveyor 30. At the end of the vessel, the textile material is discharged and is guided via the rollers 32 and 33 arranged between the vessel and the cover, whereafter the material is taken off via the guide roller 34 arranged underneath the edge of the cover. The endless conveyor travels back to the inlet with the carrying bars extending transversely across the operating width underneath the hanging loops 32.

The intermediate bottom disposed in the vessel 1 underneath the endless conveyor 30 consists of a plate 35 provided with a throughflow resistance. This intermediate bottom is preferably perforated, the perforations being variable in size, so that the throughflow resistance can be adjusted in accordance with the requirements. The flowthrough resistance of the intermediate bottom is adjusted by moving the additional sheet shown by reference numeral 13 towards the right or left, so that the flow apertures between the two sheets forming the intermediate bottom can be varied. The higher the desired upper liquid level 3, the larger must be the value of the throughflow resistance of the intermediate bottom 35. The latter can also be subdivided into perforated and imperforate zones. In the region of the imperforate zones, the liquid flow is diminished and the material is placed under less stress; as a consequence, the shrinking operation is improved.

Figure 5:
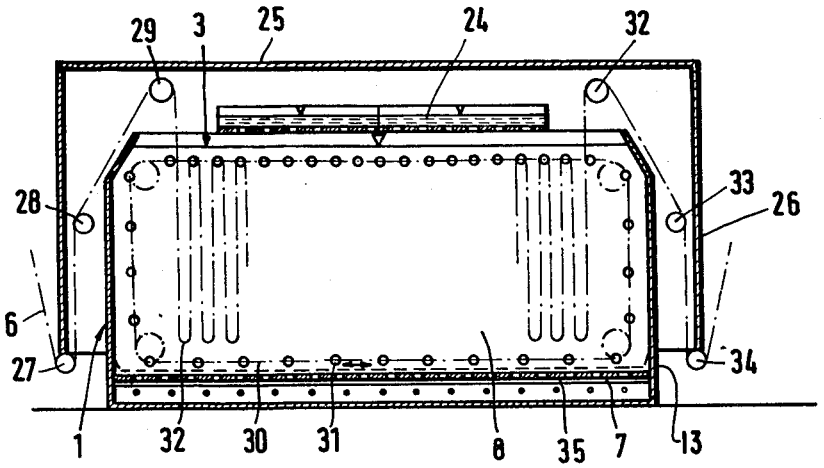
FIG. 5 shows a longitudinal section through a device having a lath-type endless conveyor means.

The container 1 according to FIG. 5 is likewise filled with a liquid via a sprinkler box 24 ensuring a uniform liquid feed to the container.

Figure 6:
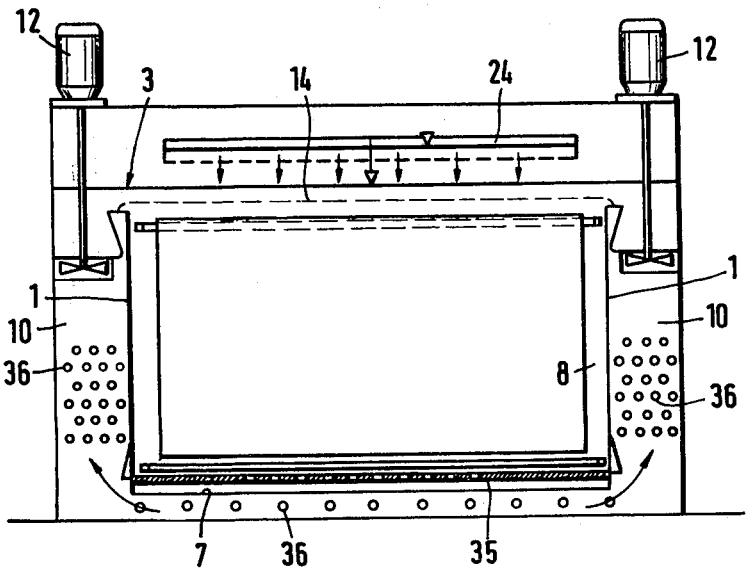
FIG. 6 shows a section transversely through the device of FIG. 5.

The embodiment according to FIG. 6 is in principle the same as that of FIG. 2. However, FIG. 6 also shows a section through the device according to FIG. 5. The vessel 1 with the treatment chamber 8 is equipped on both sides with respectively one liquid recycling chamber 10. These chambers are connected with the lower portion of the vessel, i.e. the part located underneath the intermediate bottom 35 that, as shown in this view, is provided with perforated and imperforate zones. With the aid of pumps 12 preferably controllable with respect to their circulating power, a liquid current is produced in the container which conducts the liquid, namely the sump, located in the lower portion of the container 1 via the liquid recycling chambers 10 to the sprinkler boxes 24 disposed above the level 3, thus feeding the boxes with this liquid, and the latter is then discharged uniformly by the sprinkler boxes over the area of the treatment chamber. The liquid level of the sump, i.e. the level of the liquid in the container portion underneath the intermediate bottom 35, is here again denoted by 7. The heating rods or heating coils to heat up the water are arranged in the lower container portion as well as in the recycling chambers. These heating elements are denoted by 36. It is, of course, also possible to omit the two recycling chambers laterally arranged at the container, and to extend instead, as in FIG. 4, a conduit 23 directly from the sump to the sprinkler box, the pump 22 being inserted in this conduit (see also FIGS. 7 and 8).

In the above-described arrangement of the present invention, treatment fluid is introduced into the vessel via the sprinkler box or boxes. In the treatment chamber 8, closed off in the downward direction by the intermediate bottom 35, the liquid is collected until the endless conveyor with the textile material is completely covered by liquid. Thereafter, liquid passes through the intermediate bottom into the lower portion of the vessel and forms the sump. The sump is in communication with the pump, which latter takes care that always such an amount of liquid is pumped out of the sump that a second liquid level 7 is formed below the intermediate bottom. In this way, the liquid flow in the treatment chamber is effected merely by means of gravity, thus obtaining a uniform, intensive flow without any turbulence formation. Thereby, the textile material is not placed under stress, and an erroneous alignment of the textile material is avoided. If a stronger current is required, or a current affected by the pump is necessary, then this arrangement also affords an adjustment to the effect that the second liquid level disposed underneath the intermediate bottom is eliminated.

If the arrangement is to be used for steaming or setting purposes, the throughflow resistance of the intermediate bottom is to be dimensioned so that no liquid level is formed above the intermediate bottom; rather, the liquid passes practically without resistance through the intermediate bottom and collects only in the sump. By heating the liquid in the sump, a steam atmosphere is generated within the container, constituting a steaming or setting operation, depending on the type of liquid present in the sump. Of course, it is also possible to introduce the liquid directly, without penetration of the upper container portion, rather than being fed via nozzles or via the sprinkler box into the sump in the lower container portion. If the arrangement is to be utilized for drying purposes, only a heating step is carried out by activating the heating bars, heating coils, or some other heating element.

Figure 7:
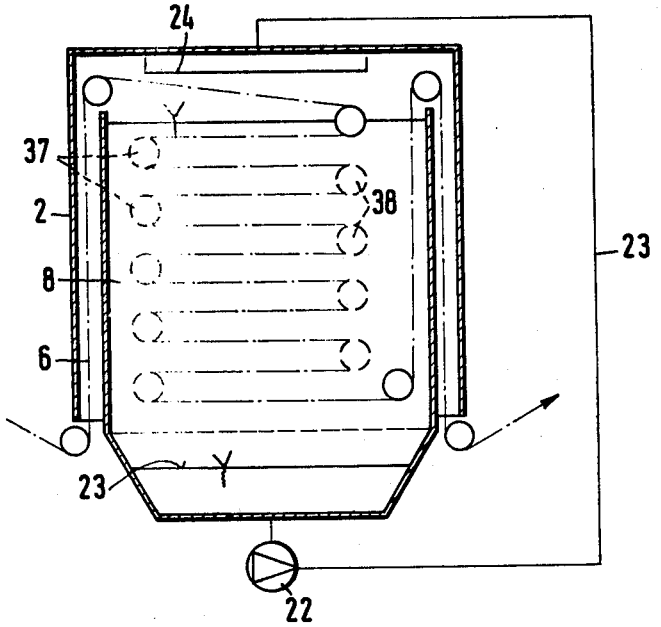
FIG. 7 shows a device with rollers for conveying the textile material.
Figure 8:
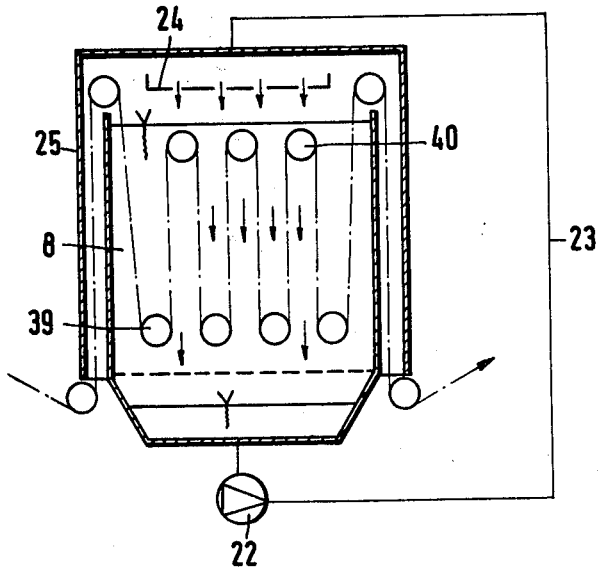
FIG. 8 shows a further modification of the invention in a longitudinal section.

The apparatus shown in FIG. 7 differs from that according to FIG. 5 in that a different type of endless conveyor means is utilized. In the embodiment according to FIG. 7, the textile material 6 is guided horizontally in the treatment chamber 8. This is made possible by arranging two rows of rolls 37 and 38 disposed one below the other. The rolls of one row are offset with respect to the rolls of the other row, so that a horizontal guidance of the textile material in rows one below the other is obtained. In this way, an improved shrinking action is provided, since in some textile materials the wet shrinkage effect is partially revoked by the weight of the hanging loops. It is also possible, as illustrated in FIG. 8, to conduct the material in a vertical, restricted manner. For this purpose, two rows of rolls 39, 40, extending horizontally one below the other, are provided, wherein the individual rolls 39 of one row are offset with respect to those of the other row, denoted by 40. In the devices according to FIGS. 7 and 8, the rolls 37–40 can be completely or partially perforated to facilitate the flow of water through the material from the top toward the bottom.

Figure 9:
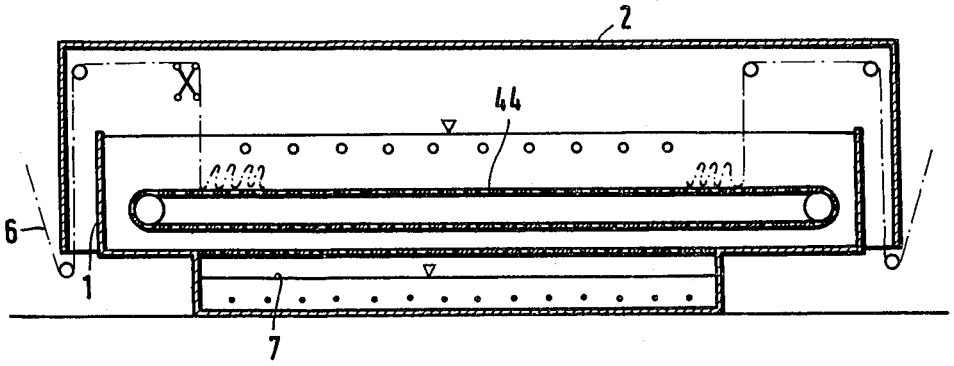
FIG. 9 shows another embodiment of the device, likewise with the use of an endless belt, in a longitudinal section.

FIG. 9 shows an apparatus wherein a conveyor belt 44 is arranged as the endless conveyor means entirely within the treatment chamber 8. The textile material 6 is placed on this conveyor in loops. In this apparatus, the treatment fluid can be fed via spray nozzles, rather than by way of sprinkler boxes, to disclose a modification of the feeding of the liquid. The sump is removed by suction in the same manner as shown in FIG. 7.

Figure 10:
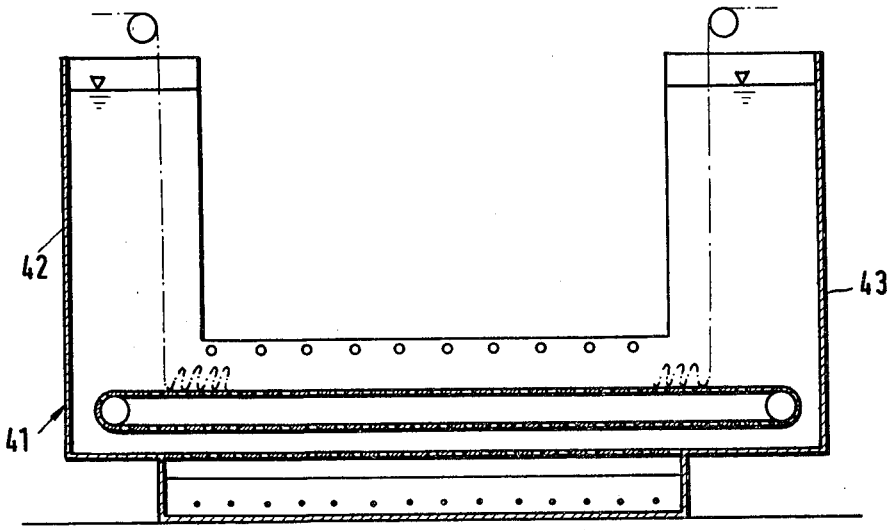
FIG. 10 shows a device for temperatures above the boiling point.

FIG. 10 shows an apparatus corresponding to that of FIG. 7, but modified for the treatment of textile material which is to be exposed to a treatment at above 100° C. As can clearly be seen from the figure, the treatment vessel 41 has a U-shape in longitudinal section. The liquid columns in the legs 42 and 43 of the vessel determine the excess pressure required for producing the desired temperature. Otherwise, the apparatus corresponds in its construction to the embodiments already described with reference to FIGS. 5–8.

Figure 11:
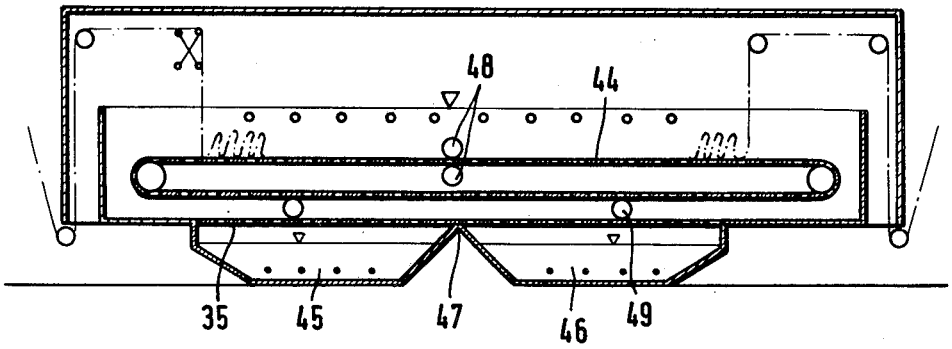
FIG. 11 shows a device according to this invention preferably for steaming or fixation.

FIGS. 9 and 11 show a device with a conveyor belt 44 intended especially for steaming and setting purposes. In this embodiment, the lower container of FIG. 11, i.e. the portion of the vessel underneath the intermediate bottom 35, is subdivided into two troughs 45 and 46 into which can be charged different treatment fluids. Above the partition 47 between the troughs 45, 46 are squeeze rolls 48. Numeral 49 denotes vent openings.

Figure 12:
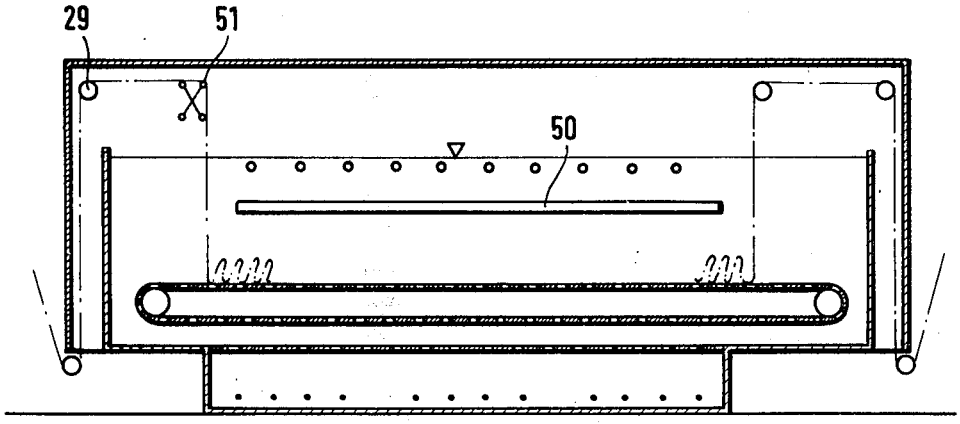
FIG. 12 shows a further embodiment of the device illustrated in FIG. 11.
Figure 14:
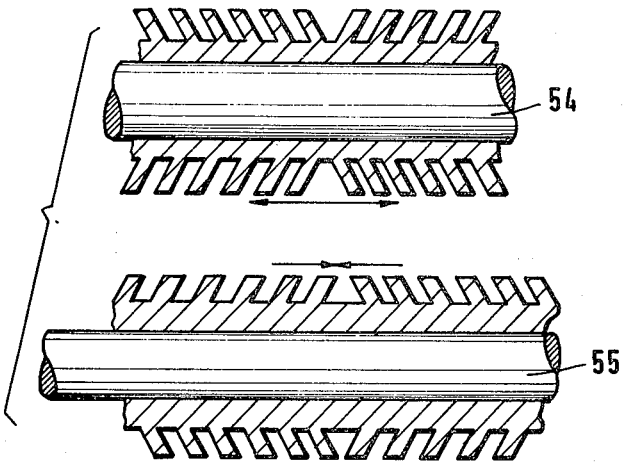
FIG. 14 shows an illustration of rollers likewise used for stretching and overfeeding.
Figure 13:
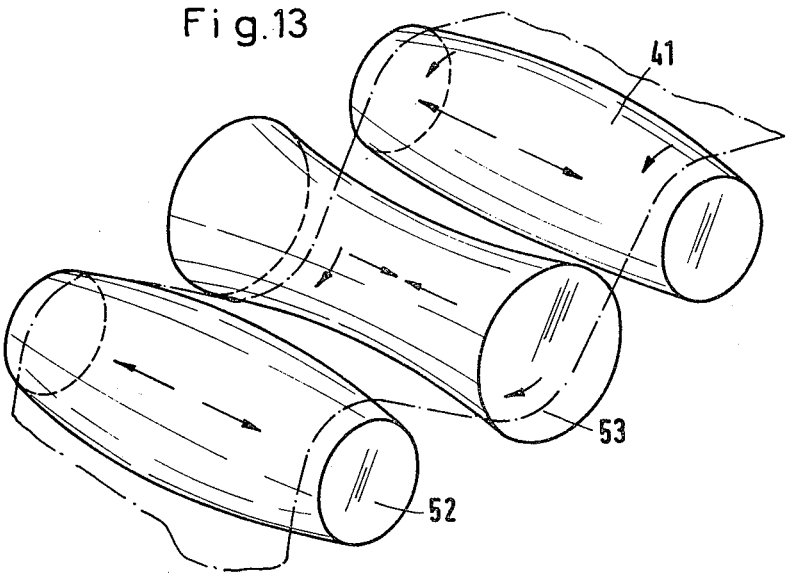
FIG. 13 shows a perspective view of overfeeding or stretching [drawing] rollers.

FIG. 12 represents an apparatus similar to that of FIG. 9, but enhanced by the arrangement of a vibrating plate 50. In place of the vibrating plate, it is possible to provide several vibrating plates, a vibrating belt, or a unit producing ultrasound. In place of the guide roller 29 or the fold-laying means 51, it is possible to provide the overfeeding or stretching rollers illustrated in FIGS. 13 and 14. According to FIG. 13, three stretching rollers are provided, consisting of the barrel-shaped rolls 52, between which a roll 53 of a correspondingly concave shape is arranged. If the textile material is guided through these rolls, it is stretched and overfed [compressed, stuffed] prior to entering the treatment bath and thus is already subjected to a preliminary compensation of the stresses introduced by the weaving or knitting operations, which stresses were produced before entering the shrinking bath. FIG. 14 shows two rolls 54 and 55 which are either made of solid rubber or carry a solid-rubber casing. To produce the overfeeding or stretching effect, these rolls are provided with teeth extending at an inclination with respect to the central axis, wherein the teeth on roll 55 are inclined in the opposite direction with respect to the teeth on roll 54. There is also the possibility of providing an embodiment wherein the outer periphery of the rolls is equipped with annularly extending projections, inclined with respect to the longitudinal axis, the inclination being in the opposite direction in one roll from that of the other. By the roll 54, a stretching action is attained, and roll 55 provides a compression [overfeeding] action.

In a further development of the devices shown in FIGS. 1–12, the additional suggestion is made to arrange underneath the sprinkler units or the nozzles a perforated cover plate, namely a sieve plate, effecting a uniform distribution of the thus-introduced treatment medium. The plate is denoted by 14 in FIG. 3 and also illustrated, for example, in FIG. 6.

With the aid of all of the arrangements of the described modifications, it is possible to conduct a washing step, as well as shrinking, setting, steaming, and drying operations, even though several embodiments are intended for certain working steps, such as, for example, the embodiment of FIG. 9 for washing and shrinking operations at above 100° C. and the embodiment of FIG. 10 for steaming and setting purposes.

Such a versatile utilization of an arrangement for the treatment of textile material has not existed heretofore. It should be noted that, in case of particularly soiled material, one of the conventional sieve-drum washing units is provided upstream or downstream of the devices of the present invention. Besides, it is possible to arrange a filter for cleaning the treatment liquid in the liquid backflow unit. Also, the liquid of the sump can be removed by pumping and a still unused liquid can be fed to the sprinkler boxes in corresponding quantities.

What is claimed is:

1. An apparatus for the wet treatment of fibrous material which comprises a container, means for providing a first liquid layer of a treatment liquid within said container, a liquid-permeable support means for supporting and transporting said material through said first liquid layer, said support means having a supporting surface on which the material is transported, and said support means being immersed in the first liquid layer and arranged below the liquid level of said first liquid layer within said container and means for maintaining a second liquid layer of the treatment liquid within said container extending uniformly along the entire length of the immersed supporting surface and spaced underneath said supporting surface of the support means to provide a free air space between said first and second liquid layers whereby liquid in the first liquid layer flows uniformly through the fibrous material supported on said support means by the effect of gravity and via said free air space into the second liquid layer.

2. An apparatus according to claim 1, wherein the support means is an endless conveyor.

3. An apparatus according to claim 2, wherein an intermediate bottom is provided underneath the endless conveyor, said bottom consisting of a plate forming a throughflow resistance.

4. An apparatus according to claim 3, wherein the throughflow resistance of the intermediate bottom is variable.

5. An apparatus according to claim 4, wherein the intermediate bottom consists of a perforated plate, the openings of which are adjustable.

6. An apparatus according to claim 3, wherein the intermediate bottom is subdivided into perforated and imperforate zones.

7. An apparatus according to claim 3, wherein the throughflow resistance of the intermediate bottom is selected so that a second liquid level is formed underneath the intermediate bottom.

8. An apparatus according to claim 2, wherein spray nozzles or sprinkler boxes are provided above the endless conveyor for supplying the treatment liquid, and an intermediate bottom consisting of a perforated plate having throughflow resistance is provided underneath the endless conveyor, the liquid collected underneath the intermediate bottom being fed via a pump unit to the spray nozzles or sprinkler boxes.

9. An apparatus according to claim 1, wherein said means for maintaining the second liquid layer includes a liquid pump means for discharging the liquid from said second liquid layer more quickly than liquid is fed from above said support means for replenishing said liquid in said first liquid layer to thereby form said free air space.

10. An apparatus according to claim 1, wherein the support means is a perforated steel belt conveyor.

11. An apparatus according to claim 10, wherein the steel belt conveyor is sealed by sliding seal means with respect to a container wall or with respect to boundary walls arranged laterally of said belt conveyor.

12. An apparatus according to claim 1, wherein said support means is an endless conveyor belt and further comprising means for sealing the endless conveyor belt with respect to walls of the container, top edges of the container walls terminating at a large distance above the endless conveyor belt.

13. An apparatus according to claim 12, wherein at least part of the lateral boundary of the endless conveyor belt is disposed at a spacing from the outer walls of the container to form a backflow duct in communication with the air space underneath the endless belt, and a top edge of a lateral boundary will for the endless belt is fashioned as an overflow edge for liquid which has been removed, underneath the endless conveyor belt and is to be recycled into the treatment bath, the top edge of the lateral boundary wall for the endless conveyor belt being arranged at a large spacing above the endless conveyor belt.

14. An apparatus according to claim 13, wherein a pump for producing the second liquid level underneath the endless conveyor belt is arranged in the backflow duct formed by the lateral boundary wall for the endless conveyor belt and an adjacent outer wall of the container.

15. An apparatus according to claim 14, wherein a pump, preferably controllable in its power, is associated with each compartment formed by the partition walls.

16. An apparatus according to claim 12, wherein at least one sieve plate extends transversely over the supporting surface of the endless conveyor belt underneath the first liquid level.

17. An apparatus according to claim 16, wherein at least one vibrating means is arranged above the endless conveyor belt.

18. An apparatus according to claim 17, wherein the vibrating means includes a plate.

19. An apparatus according to claim 1, wherein the container serving for the treatment of the textile material completely accommodates the support means.

20. An apparatus according to claim 19, wherein the support means is entirely immersed in liquid within said container.

21. An apparatus according to claim 20, wherein said support means is an endless conveyor and the endless conveyor consists of carrying bars extending transversely across the operating width of the conveyor and being joined by chains, on which bars the fibrous textile material is conveyed in hanging loops within the container.

22. An apparatus according to claim 20, wherein the support means consists of two rows of rolls arranged one below the other and being offset in rows with respect to each other, these rolls permitting a horizontal conductance of the material from the top toward the bottom within the container.

23. An apparatus according to claim 22, wherein the rolls are perforated.

24. An apparatus according to claim 20, wherein the support means consists of two rows of rolls extending horizontally one below the other, wherein the individual rolls of one row are disposed offset with respect to those of the other row.

25. An apparatus according to claim 19, wherein the container for the treatment liquid has a U-shape in a longitudinal section to produce an excess pressure in that portion of the container wherein said support means is arranged within the treatment container.

26. An apparatus according to claim 1, wherein said container includes several treatment compartments formed by partition walls and the support means arranged within the container passes through said several treatment compartments.

27. An apparatus according to claim 26, wherein said support means is a conveyor belt and the partition walls adjoin squeezing rolls which act on the belt on both sides.

28. An apparatus according to claim 26 wherein the support means is an endless belt and the entire endless belt is arranged within the container to extend past a first treatment compartment of the several treatment compartments within said container and into an inlet compartment and another liquid level underneath the supporting surface of the endless belt is provided in the inlet compartment.

29. An apparatus according to claim 28, wherein the material is deposited in the inlet compartment directly onto the endless belt, said material being laid in folds.

30. An apparatus according to claim 26, wherein the support means is an endless belt, the entire endless belt being arranged within the container, said belt extending past a last treatment compartment of the several treatment compartments and into an outlet compartment and another liquid level underneath the supporting surface of the endless belt is provided in the outlet compartment.

31. An apparatus according to claim 30, wherein the outlet compartment contains, between a material take-off device above the endless belt and the material to be removed from the endless belt, a device for supplying and for feeding water in the form of a water curtain transversely across the operating width of the endless belt.

32. An apparatus according to claim 31, wherein the take-off device is associated, upstream thereof, with means for removing the water from the material removed from the endless belt.

33. An apparatus according to claim 26, wherein a container portion located underneath the endless conveyor is subdivided at least once along its length and forms mutually separated container chambers.

34. An apparatus according to claim 1, wherein a cover laterally extends over the container and is steam-proof except for an inlet and outlet for the textile material.

35. An apparatus according to claim 1, wherein above the support means, spray nozzles or sprinkler boxes are provided for supplying the treatment liquid to said container.

36. An apparatus according to claim 1, wherein on one side or on both sides of the container, liquid recycling chambers are provided which are in communication with the container portion located underneath the support means.

37. An apparatus according to claim 36, wherein controllable pumps are associated with the liquid recycling chambers.

38. An apparatus according to claim 36, wherein heating units are arranged in the liquid recycling chambers.

39. An apparatus according to claim 1, wherein heating units are arranged at or in the close proximity of the bottom of the container.

40. An apparatus according to claim 1, wherein a unit for producing vibrations, especially ultrasonic vibrations is located in the first liquid layer of the treatment liquid.

41. An apparatus according to claim 40, wherein said unit for vibrations is combined with water feed nozzles.

42. An apparatus according to claim 1, wherein an arrangement of overfeeding rolls for the fibrous material is located in front of an inlet for the textile material into the container.

43. An apparatus according to claim 42, wherein said rolls comprise two barrel-shaped rolls and a roll disposed therebetween and having a correspondingly concave shape.

44. An apparatus according to claim 42, wherein said rolls comprise two rolls covered with rubber or similar material or consisting of rubber or a like material, the outer wall of one roll being fashioned with teeth extending at an inclination to a longitudinal axis of the roll whereas the other roll is provided with teeth inclined in the opposite direction therefrom.

45. An apparatus according to claim 42, wherein the rolls comprise two rolls covered with rubber or a similar material or consisting of rubber or a like material, and the outer wall of the rolls is provided with annularly extending projections inclined with respect to a longitudinal axis, the inclinations being in opposite directions in the two rolls.

46. An apparatus for the wet treatment of fibrous material, which comprises a container, means for producing a first liquid layer in said container, a liquid permeable conveyor support means for transporting a fibrous material on a supporting surface through said first liquid layer, means for maintaining the liquid level of said first liquid layer above said fibrous material on said supporting surface of said conveyor support means, means for producing a second liquid layer in said container, and means for maintaining the liquid level of the second liquid layer below the first liquid layer to provide a free air space between said first and second liquid layers whereby liquid in the first liquid layer flows by the effect of gravity through the fibrous material being transported on said conveyor support means and via said air space into said second liquid layer, the flow of liquid taking place uniformly through the fibrous material and over said supporting surface.

47. An apparatus according to claim 46, wherein said apparatus further comprises means for introducing the fibrous material in the form of a continuous length of material on to said supporting surface.

48. An apparatus according to claim 1, wherein said apparatus further comprises means for introducing the fibrous material in the form of a continuous length of material on to said supporting surface.

* * * * *